US012006678B2

(12) United States Patent
Davis

(10) Patent No.: US 12,006,678 B2
(45) Date of Patent: Jun. 11, 2024

(54) VENTING CLIP FOR A FLOOR DRAIN ASSEMBLY

(71) Applicant: OATEY CO., Cleveland, OH (US)

(72) Inventor: Alexander L Davis, Mentor, OH (US)

(73) Assignee: Oatey Co., Cleveland, OH (US)

( * ) Notice: Subject to any disclaimer, the term of this patent is extended or adjusted under 35 U.S.C. 154(b) by 137 days.

(21) Appl. No.: 17/727,041

(22) Filed: Apr. 22, 2022

(65) Prior Publication Data

US 2022/0341148 A1 Oct. 27, 2022

Related U.S. Application Data

(60) Provisional application No. 63/178,624, filed on Apr. 23, 2021.

(51) Int. Cl.
*E03F 5/04* (2006.01)
*A47K 3/40* (2006.01)

(52) U.S. Cl.
CPC ..... *E03F 5/0408* (2013.01); *A47K 3/40* (2013.01)

(58) Field of Classification Search
CPC ..... E03F 5/0408; E03F 5/0407; E03F 5/08; E03C 1/22; A47K 3/40
See application file for complete search history.

(56) References Cited

U.S. PATENT DOCUMENTS 7,739,757 B2 * 6/2010 Witt ..... E03F 5/0408 4/612
9,822,539 B1 * 11/2017 Krombein ..... E03F 5/0408
9,988,800 B2 * 6/2018 Muirhead ..... E03F 5/0408

* cited by examiner

*Primary Examiner* — Janie M Loeppke
(74) *Attorney, Agent, or Firm* — BakerHostetler

(57) ABSTRACT

A drain assembly is installed into the floor of a shower stall or in the floor of a room to allow water or fluids to be drained. The drain assembly is attached to a drain pipe to allow water to drain from the drain assembly. The drain assembly includes a base that receives a tray, wherein the tray is spaced apart from the base by way of at least one venting clip. The venting clip includes a venting channel configured to provide a fluid pathway that extends from a position adjacent to a central opening that is in fluid communication with the drain pipe to the ambient air about the drain assembly. The venting channel is configured to allow air to escape from the drain pipe to normalize the pressure between the drain pipe and the ambient air therewithin to prevent the backup of water within the drain.

20 Claims, 19 Drawing Sheets

VENTING CLIP FOR A FLOOR DRAIN ASSEMBLY

CROSS-REFERENCE TO RELATED APPLICATIONS

This application claims benefit to U.S. Provisional Application No. 63/178,624, filed Apr. 23, 2021, the entirety of which is incorporated by reference herein.

TECHNICAL FIELD

The present invention relates to shower stalls or floors of a building, and more particularly to a floor drain assembly for allowing water to drain out of the shower or room.

BACKGROUND

Some residential homes and businesses provide shower stalls 10 (FIG. 1), or stand-alone showers, wherein the shower stall includes a shower head 11 that extends from the ceiling or side wall as well as a drain assembly 12 positioned in the floor or base of the shower stall. The drain assembly 12 provides a pathway through which the water from the shower head 11 exits the shower stall 10 to be transported away. In the exemplary shower stall 10 provided in FIG. 1, the shower head 11 is a rain shower head that provides water that falls from the shower head to the floor or base of the shower stall to give a user a rain-shower effect.

FIGS. 2A-2B illustrates a known drain assembly 12 that can be positioned in shower stalls. The drain assembly 12 includes a base 14 connected to an adapter 18, which allows the tray 14 to be connected to a threaded drain pipe (not shown). The base 14 receives a strainer 22 for straining debris from passing through the adapter 18 and into the drain pipe. The base 14 further receives a tray 16. The tray 16 is configured to receive tiles that match the surrounding shower base, wherein the tiles are attached to the tray in order to maintain a substantially continuous tile pattern across the entire shower base. A spacer 20 is attached to each corner of the tray 16 to provide a gap between the tray 16 and the base 14, wherein water flows into the drain assembly 12 through the gap between the tray 16 and base 14 and through the strainer 22 to the drain pipe.

For shower stalls 10 having a rain shower head 11, particularly when the rain shower head 11 is positioned directly above drain assembly 12, water often flows into the drain assembly 12 from all sides, as shown in FIG. 2D. This often happens when a user turns on the flow of water to get the water to warm up at the beginning of the shower. As the water flows into the drain assembly 12 from all sides, there is a pressure differential created as a result of air within the drain pipe not being allowed to escape around the tray 16. This pressure differential eventually prevents water from flowing through the adapter 18 and into the drain pipe, thereby causing the water to back-up and accumulate within the base of the shower stall 10. Continued flow of water from the shower head 11 while the pressure differential remains can cause the shower stall 10 to flood. While this is described as happening for this square-shaped drain assembly 12 in combination with a rain shower head 11 positioned directly above the drain assembly, it should be understood that this can also happen with other shapes of drain assemblies and other shower head types in which the flow of water enters the drain assembly from all sides at the same time. It is also not necessary that the shower head be installed directly above the drain assembly for the pressure differential that leads to a water back-up to happen.

A need therefore exists for a drain assembly that prevents the creation of such a pressure differential that causes the back-up of the flow of water through the drain assembly.

SUMMARY

The present invention includes a venting clip of a drain assembly. The venting clip includes a support portion having a portion of a venting channel formed therein. A gap portion extends from the support portion. The gap portion includes another portion of the venting channel. The venting channel is fluidly connected to a drain pipe to allow pressure equalization within the drain pipe when water flows into the drain assembly.

In one aspect of the present invention, a drain assembly is provided. The drain assembly includes a base defining a base volume. The base includes a bottom wall, wherein the bottom wall includes a recessed portion defining a central opening. A tube extends from the recessed portion for allowing water to drain from the base volume. The drain assembly further includes a tray positionable within said base volume. The drain assembly also includes two or more venting clips positioned between the tray and the base. Each venting clip defines a venting channel for equalizing pressure between air within the tube and ambient air.

In another aspect of the present invention, a venting clip of a drain assembly for equalizing pressure between air within a drain pipe and ambient air is provided. The venting clip includes a support portion defining a first portion of a venting channel. The venting clip further includes a gap portion extending from said support portion. The gap portion defines a second portion of the venting channel. The first portion and the second portion of the venting channel are in fluid communication therebetween. The venting clip further includes at least one aperture formed in the gap portion to fluidly connect air within the venting channel with ambient air to allow pressure normalization between air within the drain pipe and ambient air.

This summary is provided to introduce a selection of concepts in a simplified form that are further described below in the Detailed Description section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there are shown in the drawings illustrative embodiments of the disclosure. It should be understood, however, that the application is not limited to the precise arrangements and instrumentalities shown. In the drawings.

DETAILED DESCRIPTION

Figure 1:
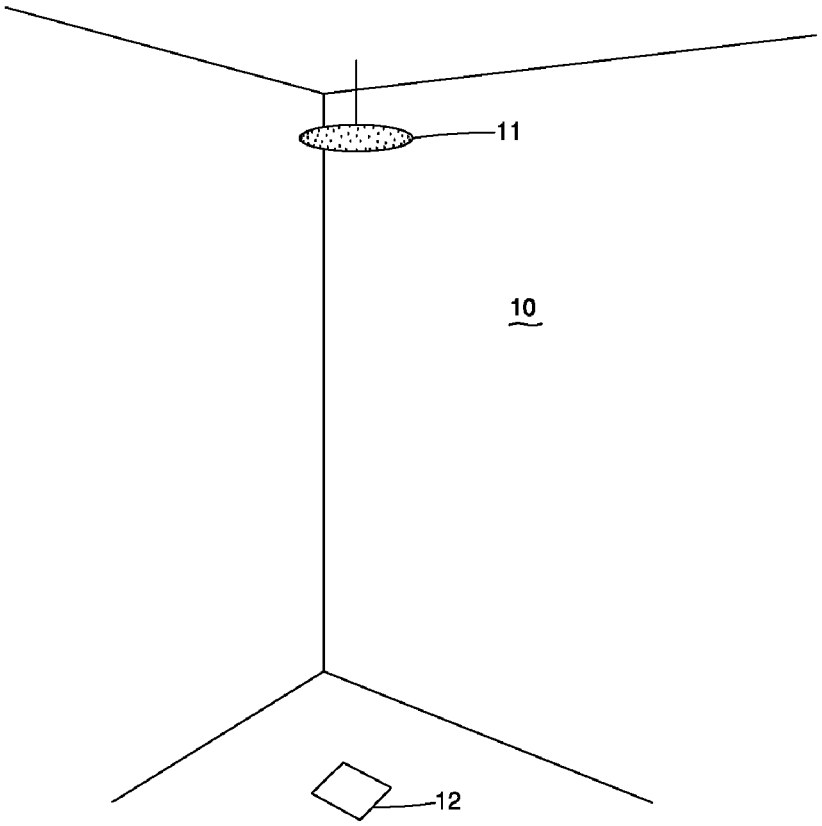
FIG. 1 is an exemplary shower stall.
Figure 2A:
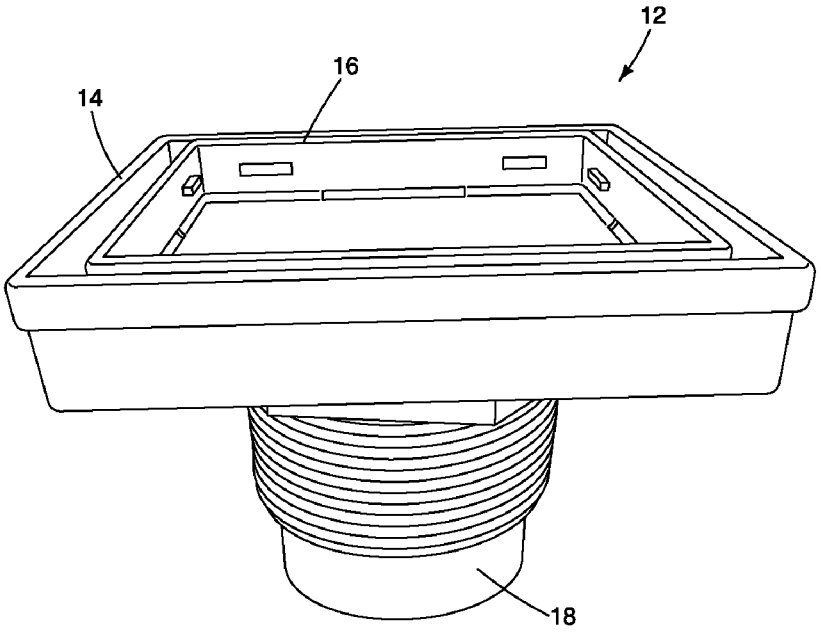
FIG. 2A Prior Art
FIG. 2A is a prior art drain assembly.
Figure 2B:
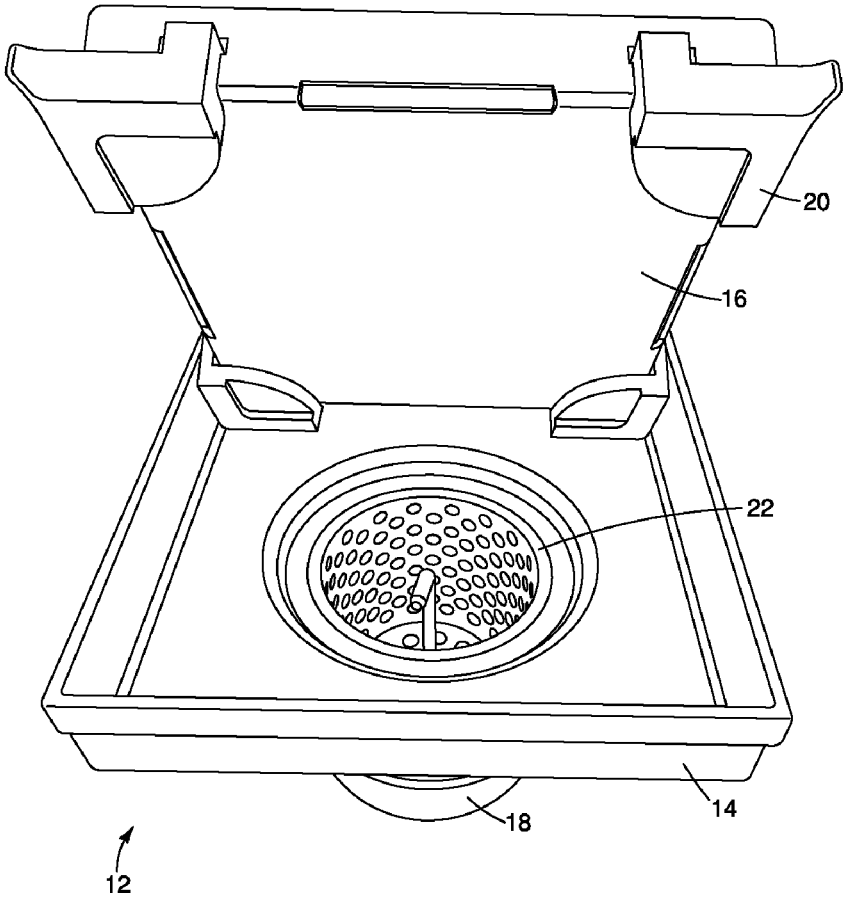
FIG. 2B Prior Art
FIG. 2B is the prior art drain assembly shown in FIG. 2A with four spacers supporting a tray.
Figure 2C:
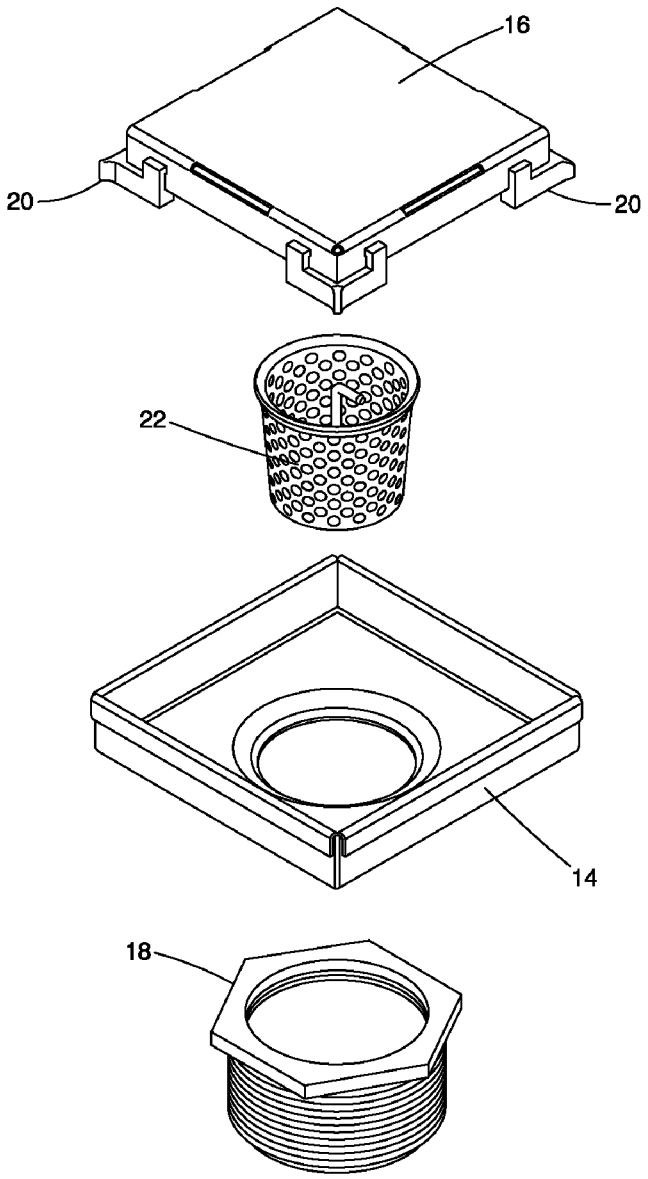
FIG. 2C Prior Art
FIG. 2C is an exploded view of the prior art drain assembly shown in FIG. 2A.
Figure 2D:
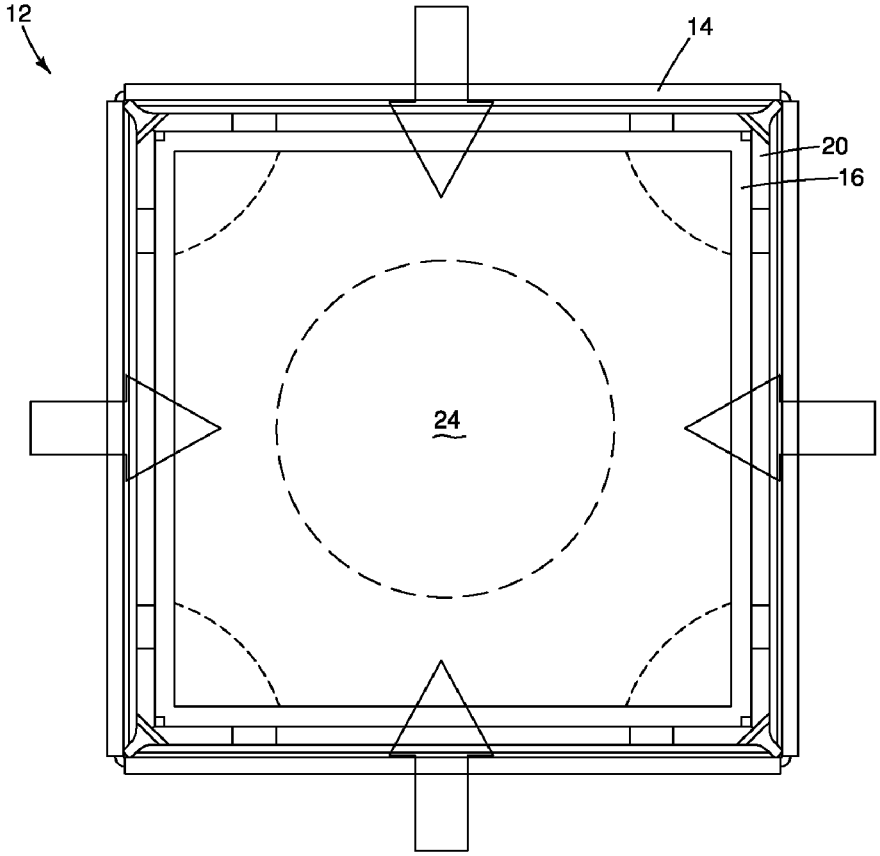
FIG. 2D Prior Art
FIG. 2D is a top view of the prior art drain assembly shown in FIG. 2A having a central opening.

Referring to FIGS. 3A-3E, an exemplary embodiment of an improved drain assembly 112 is shown. The drain assembly 112 is configured to drain water and/or liquids from the floor of a room or shower to a drain pipe 113 (FIG. 3D) for draining away from the room or shower. The drain assembly 112 includes a base 114, a tray 116 removably receivable within the base 114, and at least one venting clip 130 positioned between the base 114 and the tray 116 to provide a gap therebetween through which water flows from the shower stall to the drain pipe 113 while also providing a pressure relief channel configured to normalize the pressure differential between air within the drain pipe or the tube 139 of the base 114 and ambient air surrounding the drain assembly 112. At least a portion of each venting clip 130 is positioned above a central opining of the base 114 to provide a fluid pathway between the air in the tube 139 or drain pipe and the ambient air. In some embodiments, the drain assembly 112 further includes a strainer 122 receivable within the base 114. In some other embodiments, the drain assembly 112 includes an adapter 118 that is attachable to the base 114 to allow the drain assembly 112 to be connected to a drain pipe 113 having a threaded connection. The embodiment shown in FIGS. 3A-3C and 3E illustrates a combination of two venting clips 130 and two spacers 20 positioned between the base 114 and the tray 116, but it should be understood that the drain assembly 112 may include one (1), two (2), three (3), or four (4) venting clips 130 positioned between the tray 116 and the base 114. Further, the base 114 and tray 116 are both shown as being square in FIGS. 3A-3E, but it should be understood by one having ordinary skill in the art that they can be formed of any shape such as round, oval, triangular, any polygon, or any other shape, provided the base 114 and tray 116 are substantially the same shape. Each venting clip 130 of the drain assembly 112 is configured to provide a continuous venting channel between the central opening in the base 114 and the ambient air above the drain assembly 112 to prevent the flow of water through the gap between the base 114 and tray 116 from causing a pressure differential that results in water back-up by not being allowed to flow to the drain pipe 113.

Figure 4A:
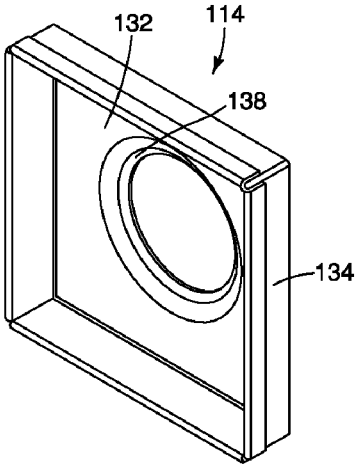
FIG. 4A is a top perspective view of a base of the drain assembly.
Figure 4B:
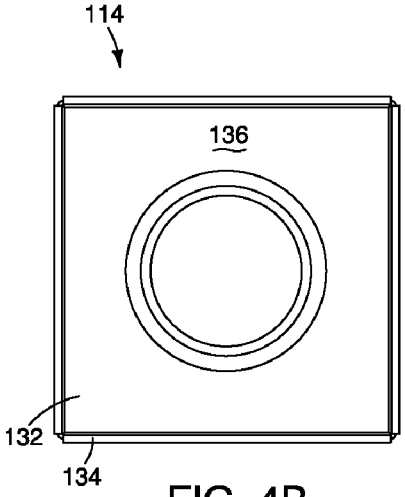
FIG. 4B is a top view of the base shown in FIG. 4A.
Figure 4C:
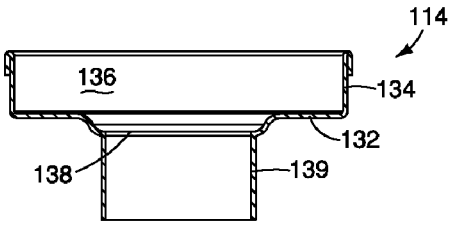
FIG. 4C is a cross-sectional view of the base shown in FIG. 4A.
Figure 5A:
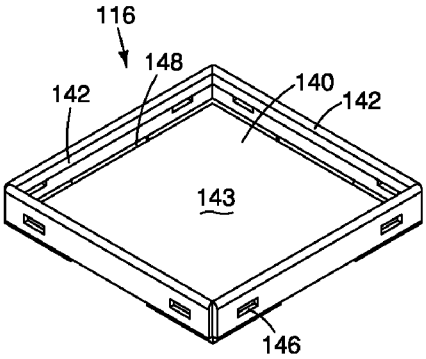
FIG. 5A is a perspective view of a tray of the drain assembly.
Figure 5B:
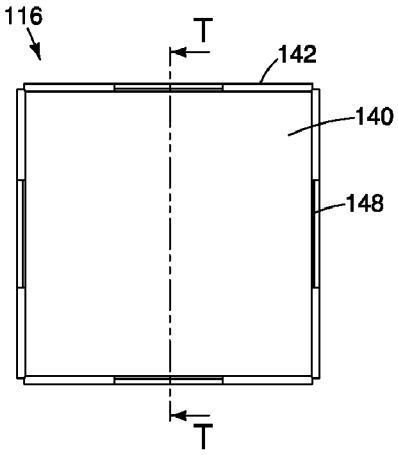
FIG. 5B is a to view of the tray shown in FIG. 5A.
Figure 5C:
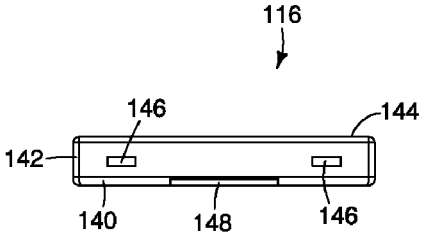
FIG. 5C is a side view of the tray shown in FIG. 5A.
Figure 5D:
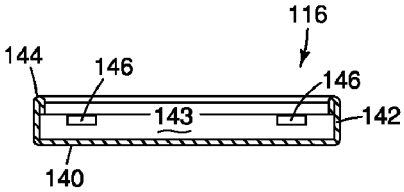
FIG. 5D is a cross-sectional view of the tray shown in FIG. 5A.

FIGS. 4A-4C illustrate an exemplary embodiment of a base 114 of the drain assembly 112. The base 114 is formed generally as a dish or basin for receiving the tray 116. In the exemplary embodiment, the base 114 has a generally square shape with a bottom wall 132 and four (4) sidewalls 134 that extend at the same angle from the bottom wall 132. The bottom wall 132 and sidewalls 134 define a base volume 136 therewithin. A central opening 138 is defined by a recessed portion centrally located in the bottom wall 132, wherein the recessed portion includes an aperture forming the central opening 138 is formed through the recessed portion. The recessed portion of the bottom wall 132 is formed as a continuous surface with the bottom wall 132 but is sloped or curved downwardly away from the upper surface of the bottom wall 132. The recessed portion of the bottom wall 132 has a generally round shape to correspond to the cross-sectional shape of the drain pipe 113. A tube 139 extends from the lower surface of the bottom wall 132 such that the central opening 138 provides fluid communication between the tube 139 and the base volume 136. The tube 139 is integrally formed with the bottom wall 132. The central opening 138 is fluidly connected to the drain pipe 113 by way of the tube 139. The central opening 138 allows water within the base volume 136 to exit therefrom and flow into the drain pipe 113. In some embodiments, the diameter of the central opening 138 formed in the bottom wall 132 of the base 114 should correspond generally to the diameter of the drain pipe 113 to which the central opening 138 is fluidly connected. In other embodiments, an adapter 118 can be connected to the tube 139, wherein the adapter is configured to provide a connection between the tube 139 and the drain pipe 113 when the tube 139 and drain pipe 113 have different diameters. In the illustrated embodiment, the bottom wall 132 of the base 114 is substantially planar. The surface of the bottom wall 132 immediately surrounding the central opening 138 is recesses or otherwise offset from the rest of the planar bottom wall 132. In another embodiment, the bottom wall 132 is sloped from each of the sidewalls 134 toward the central opening 138 so as to guide any water within the base volume 136 toward the central opening 138.

FIGS. 5A-5D illustrate an exemplary embodiment of a tray 116 of the drain assembly 112. The tray 116 is formed generally as a dish or basin for receiving tiles or other decorative flooring, wherein the flooring received within the tray 116 can be coordinated to match the flooring surrounding the drain assembly 112. In the illustrated embodiment, the tray 116 has a generally square shape with a lower wall 140 and four (4) sidewalls 142 that extend at the same angle from the lower wall 140. It should be understood by one having ordinary skill in the art that although the illustrated embodiment of the tray 116 has a square shape, the tray 116 can be formed of any shape that corresponds to the shape of the base 114. The lower wall 140 and sidewalls 142 define a tray volume 143 therewithin. The upper end 144 of each of the sidewalls 142 is rounded, curved, or doubled-over in order to prevent a sharp edge that may potentially cut a user's foot. Each sidewall 142 of the tray 116 includes a slots 146 formed therein and positioned adjacent to each corner of the tray 116, wherein each pair of slots 146 located at each corner is configured to allow a clip 130 or spacer 20 to be removably attached thereto. In other embodiments, the tray 116 does not include the slots 146. The tray 116 further includes at least one channel 148 formed at the intersection between the lower wall 140 and at least one of the sidewalls 142. In the illustrated embodiment, the tray 116 includes a channel 148 formed at the intersection between the lower wall 140 and each of the sidewalls 142. The channels 148 are configured to allow any water or fluid that seeps through the tiles (not shown) positioned within the tray 116 to exit the tray 116.

Figure 6A:
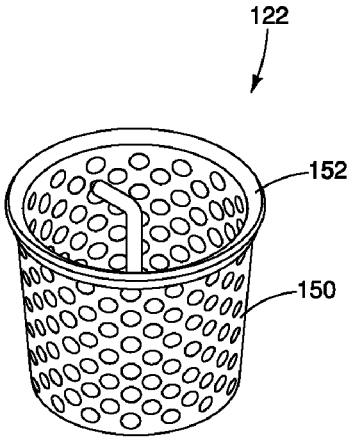
FIG. 6A is a top perspective view of a strainer.
Figure 6B:
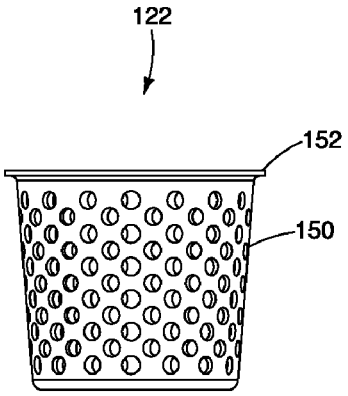
FIG. 6B is a side view of the strainer shown in FIG. 6A.
Figure 6C:
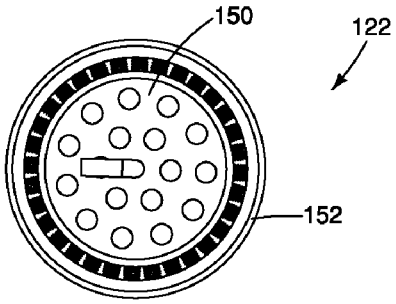
FIG. 6C is a top view of the strainer shown in FIG. 6A.

FIGS. 6A-6C illustrate an exemplary embodiment of a strainer 122 of the drain assembly 112. The strainer 122 is configured to prevent hair and other debris from entering the drain pipe 113 and getting stuck or creating a clog in a P-trap (not shown). The strainer 122 includes a cup-shaped body 150 having a flange 152 extending radially outward at the upper end of the body 150. The strainer 122 is inserted into the central opening 138 of the base 114. The flange 152 of the strainer 122 engages the recessed portion of the bottom wall 132 of the base 114 surrounding the central opening 138 to prevent the strainer 122 from falling through the central opening 138. The strainer 122 includes a plurality of apertures formed through the body 150 to form a perforated member.

Figure 7A:
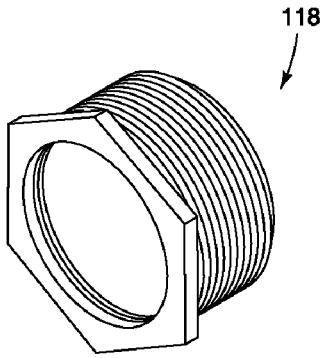
FIG. 7A is a top perspective view of an adapter.
Figure 7B:
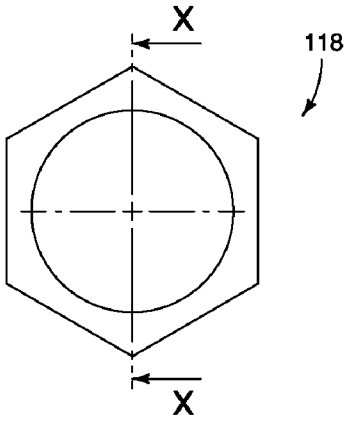
FIG. 7B is a top view of the adapter shown in FIG. 7A.
Figure 7C:
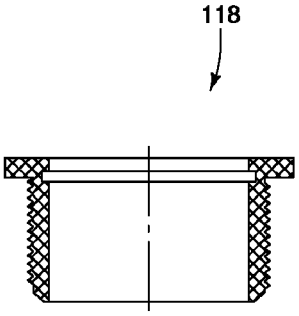
FIG. 7C is a cross-sectional view of the adapter shown in FIG. 7A.
Figure 8A:
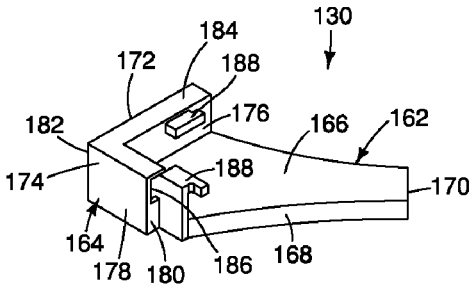
FIG. 8A is a top perspective view of a venting clip of the improved drain assembly.
Figure 8B:
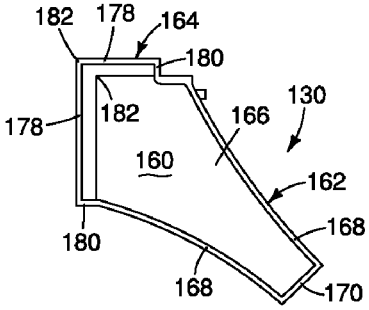
FIG. 8B is a bottom view of the venting clip shown in FIG. 8A.
Figure 8C:
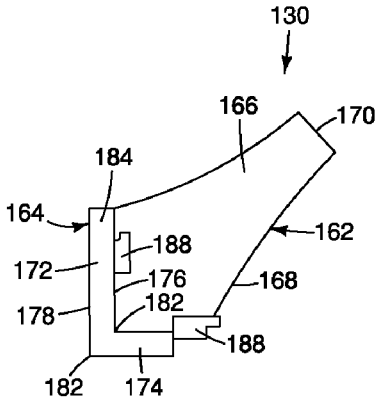
FIG. 8C is a top view of the venting clip shown in FIG. 8A.
Figure 8D:
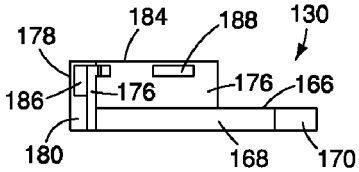
FIG. 8D is a first side view of the venting clip shown in FIG. 8A.
Figure 8E:
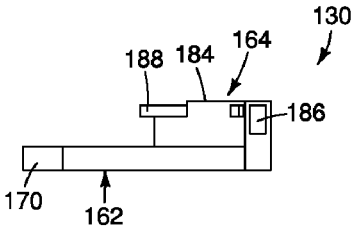
FIG. 8E is a second side view of the venting clip shown in FIG. 8A.

FIGS. 7A-7C illustrate an exemplary embodiment of an adapter 118 to provide a fluid connection between the base 114 and the drain pipe 113. The adapter 118 is a generally cylindrical member having a shaped flange that extends radially outward from one end of a cylindrical body. The cylindrical body is externally threaded to allow the drain assembly to be connected to a threaded drain pipe 113. The adapter 118 can be fixedly connected to the tube 139 of the base 114 or can be connected to the outer surface of the tube 139 of the base 114 in an abutting manner with an O-ring positioned between the inner surface of the cylindrical body and the outer surface of the tube 139 of the base 114.

Figure 3A:
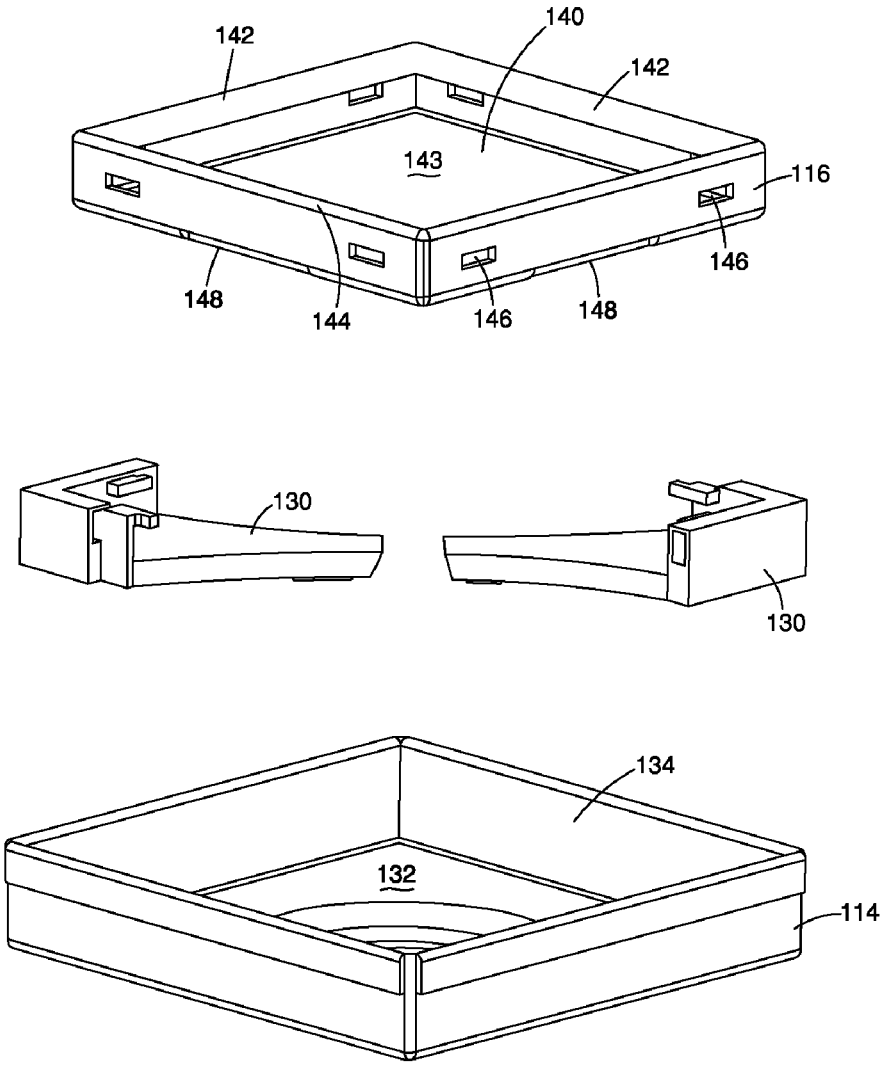
FIG. 3A is an exploded view of an improved drain assembly having a pair of venting clips.
Figure 3B:
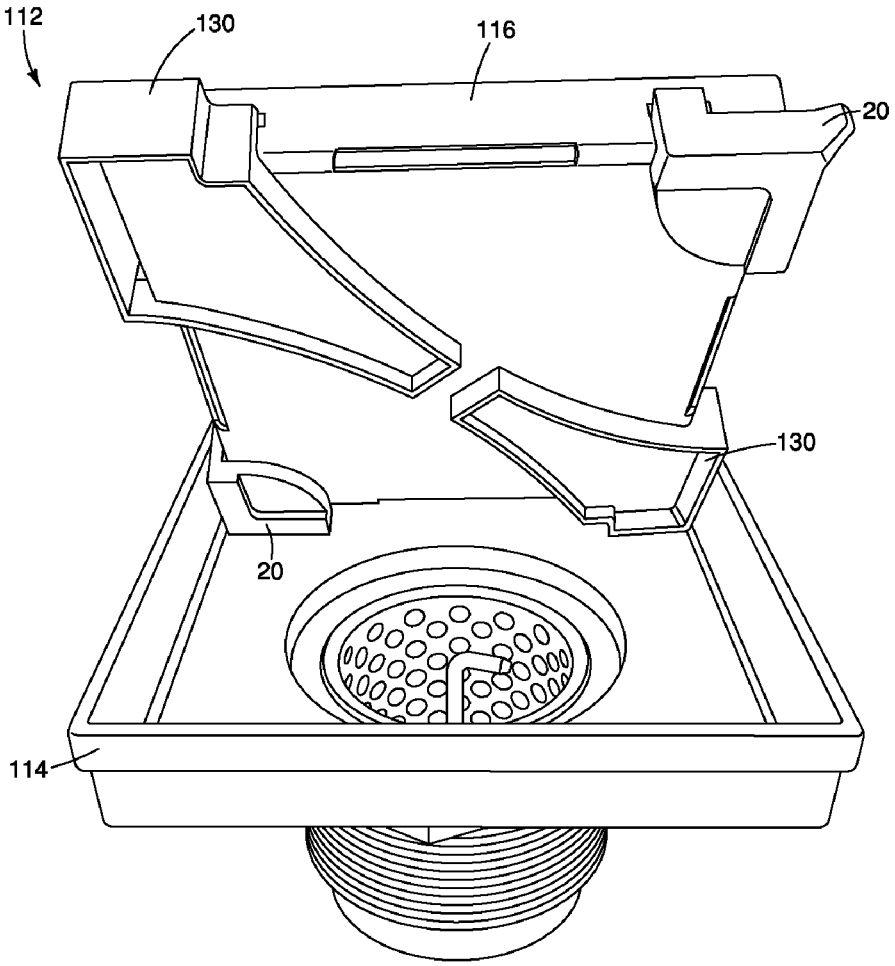
FIG. 3B is a bottom view of a tray having a pair of venting clips and a pair of spacers attached thereto.
Figure 3C:
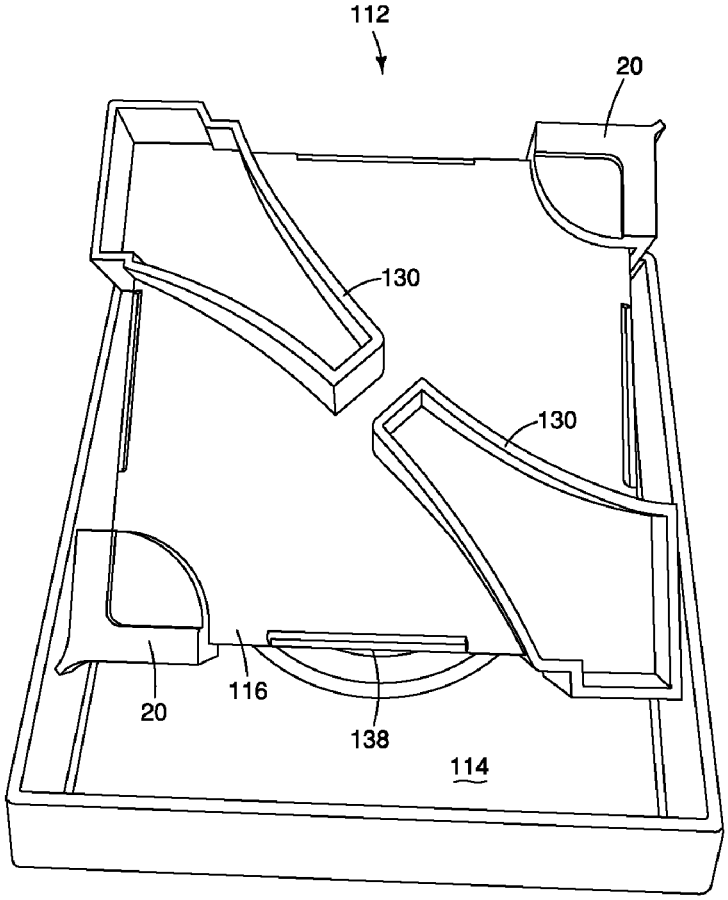
FIG. 3C is another bottom view of the tray of the drain assembly shown in FIG. 3A having a pair of venting clips and a pair of spacers attached thereto.
Figure 3D:
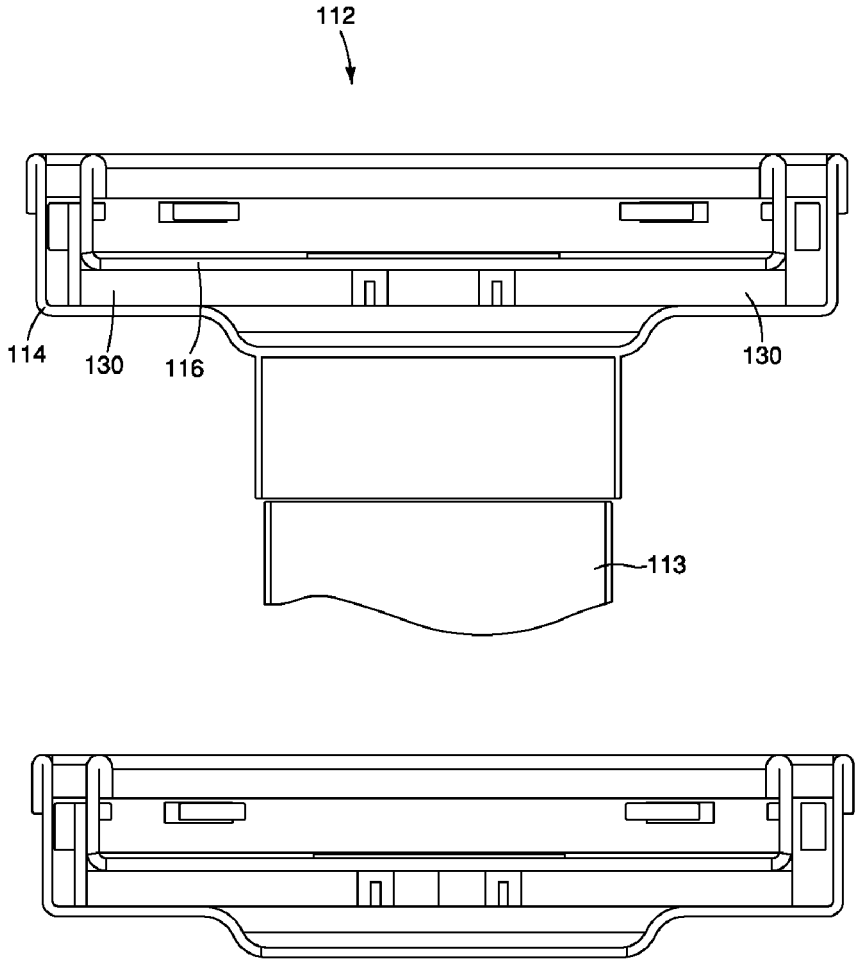
FIG. 3D is a cross sectional view of the drain assembly shown in FIG. 3A.
Figure 3E:
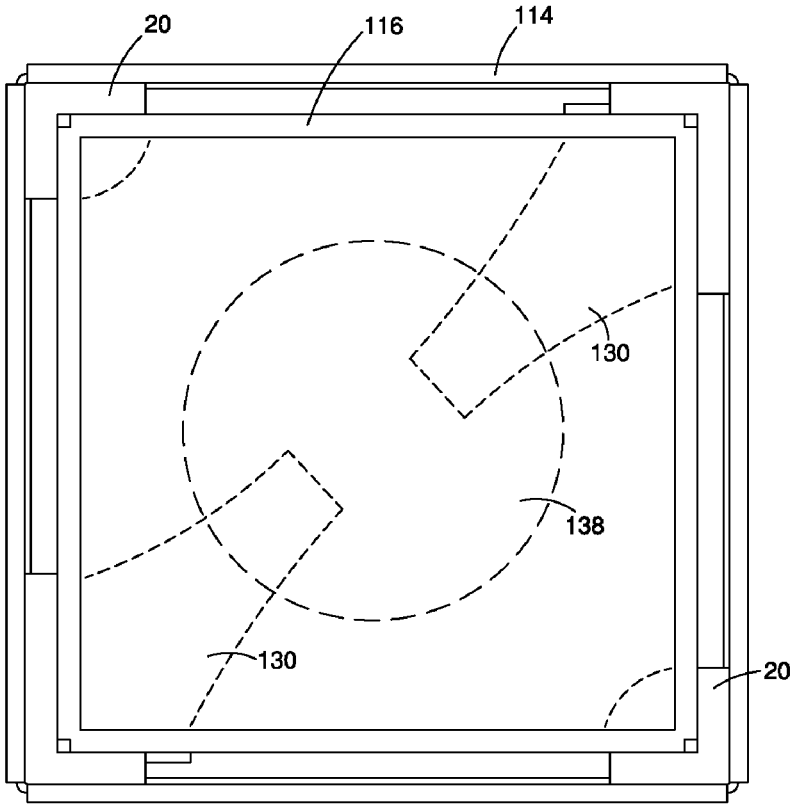
FIG. 3E is a top view of the prior art drain assembly shown in FIG. 3A having a central opening.

FIGS. 8A-8E illustrate an exemplary embodiment of a venting clip 130. The venting clip 130 is configured to provide a continuous venting channel 160 between the space above the central opening 138 of the base 114 that is in fluid communication with the drain pipe 113 to the ambient environment above the drain assembly 112. This venting channel 160 allows the pressure within the drain pipe 113 to be normalized or otherwise equalized as water and/or other fluids flow into the drain assembly 112 by allowing air to easily pass between the ambient environment and the drain pipe 113. The venting channel 160 of the venting clip 130 extends from a position directly above the recessed portion of the bottom wall 132 of the base 114 to the gap between the base 114 and the tray 116, as shown in FIGS. 3D-3E.

In the exemplary embodiment of the venting clip 130 shown in FIGS. 8A-8E, the venting clip 130 includes a support portion 162 and a gap portion 164. The support portion 162 extends from the gap portion 164, wherein the support portion 162 and gap portion 164 both define portions of the venting channel 160 that are fluidly connected together. The support portion 162 extends from the gap portion 164, forming a unitary member. The support portion 162 is positioned between the upper surface of the bottom wall 132 of the base 114 and the lower surface of the lower wall 140 of the tray 116, wherein a portion of the lower end of the support portion 162 rests on the upper surface of the base 114 and a portion of the lower surface of the tray 116 rests on the upper end of the support portion 162. The support portion 162 of the venting clip 130 is configured to provide a buffer or space between the upper surface of the bottom wall 132 of the base 114 and the lower surface of the lower wall 140 of the tray 116. The support portion 162 is generally an upside-down U-shape, wherein the support portion 162 includes a top wall 166 and a pair of sidewalls 168 that extend from opposing sides of the top wall 166. The sidewalls 168 are spaced apart and connected by the top wall 166, thereby defining a volume therebetween. The lower edge of the sidewalls 168 are configured to contact the upper surface of the bottom wall 132 of the base 114 between the sidewalls 134 (or a location adjacent to the sidewalls 134) of the base 114 and the portion of bottom wall 132 of the base 114 that surrounds the recessed portion, as shown in FIGS. 3D-3E. This contact between the sidewalls 168 of the venting clip 130 and the base 114 prevents infiltration of water into the venting channel 160 along the bottom wall 132 of the base 114 between the recessed portion and the sidewalls 134 of the base 114. A portion of the support portion 162 and the venting channel 160 defined thereby extend over the recessed portion of the bottom wall 132 of the base 114, thereby providing a gap between the central opening 138 of base 114 and the bottom edges of the sidewalls 168 of the support portion 162 of the venting clip 130. By extending at least partially over the recessed portion of the bottom wall 132 of the base 114 and over the central opening 138, the portion of the venting channel 160 defined by the support portion 162 of the venting clip 130 maintains a continuous fluid connection between the air within the drain pipe 113.

In the exemplary embodiment, illustrated in FIGS. 8A-8E, an end wall 170 is formed at the distal end of the support portion 162 opposite the gap portion 164. The end wall 170 extends between the opposing sidewalls 168 and the top wall 166 to close the end of the venting channel 160. In other embodiments, the support portion 162 does not include an end wall such that the distal end of the support portion 162 is open.

As shown in FIGS. 8A-8E, the sidewalls 168 of the illustrated embodiment of the venting clip 130 extend from the gap portion 164 in a substantially V-shaped manner in which the distance between the sidewalls 168 adjacent to the gap portion 164 is greater than the distance between the sidewalls 168 at the opposing distal end of the support portion 162. In some embodiments, the sidewalls 168 can be oriented substantially parallel to each other. In further embodiments, the sidewalls 168 can be oriented in any manner relative to each other so long as the sidewalls 168 are spaced apart to provide a portion of the venting channel 160 therebetween. The length of each sidewall 168 may vary, but the sidewalls 168 should be of sufficient length to extend from the gap portion 164 to a position over the recessed portion of the bottom wall 132 of the base 114.

The gap portion 164 of the venting clip 130 is configured to provide a space or buffer between the sidewalls 134 of the base 114 and the sidewalls 142 of the tray 116, wherein water is allowed to flow through the space or buffer provided by the venting clip 130. As shown in FIGS. 8A-8E, the gap portion 164 of the illustrated embodiment of the venting clip 130 is generally L-shaped, having a first leg 172 and a second leg 174. The second leg 174 extends from the first leg 172 at an angle. In the illustrated embodiment, the second leg 174 extends from the first leg in a substantially perpendicular manner, forming a corner therebetween. In other embodiments, the second leg 174 extends from the first leg in a non-perpendicular manner.

In an embodiment, the gap portion 164 is substantially hollow and forms a portion of the venting channel 160 that is in fluid communication with the portion of the venting channel 160 defined by the support portion 162 of the venting clip 130. Both the first and second legs 172, 174 of the gap portion 164 include an inner wall 176 and an outer wall 178, wherein the junction of the inner walls 176 form a corner 182 and the junction of the outer walls 178 form another corner 182, as shown in FIGS. 8A-8E. The inner walls 176 extend upwardly from and integrally formed with the top wall 166 of the support portion 162. The outer walls 178 are oriented substantially parallel to the inner walls 176 and spaced apart therefrom. A continuous top wall 184 extends substantially perpendicular to and connects the inner and outer walls 176, 178, wherein the top wall 184 is positioned at the upper end of the inner and outer walls 176, 178. The inner and outer walls 176, 178 and the top wall 184 define a volume therein that forms a portion of the venting channel 160. In the illustrated embodiment, the outer walls 176 extend downwardly from the top wall 184 further than the inner walls 176 because the inner walls only extend to the intersection with the top wall 166 of the support portion 162. The lower edge of the outer walls 176 opposite the top wall 184 are substantially coplanar with the lower edge of the sidewalls 168 of the support portion 162. The contact between the lower edge of the venting clip 130 and upper surface of the bottom wall of the base 114 prevents water within the base volume 136 from entering the venting channel 160.

In the illustrated embodiment, an end wall 180 extends between the inner and outer walls 176, 178 and the top wall 184 at the distal ends of the first and second legs 172, 174 of the gap portion 164 of the venting clip 130 opposite the corners 182 thereof, as shown in FIGS. 8A-8E. The lower edge of the end walls 180 are coplanar with the lower edge of the outer walls 176 as well as the lower edge of the sidewalls 168 of the support portion 162. In the illustrated embodiment, an aperture 186 is formed at each distal end of the first and second legs 172, 174, wherein the apertures 186 are defined as a gap between an upper edge of an end wall 180 and a lower edge of the top wall 184. The apertures 186 are in fluid communication with the venting channel 160 to provide an opening through which air can enter/exit the venting channel 160 to equalize the pressure within the drain pipe 113. The apertures 186 provide fluid communication between venting channel 160 of the venting clip 130 and the gap between the sidewalls 134 of the base 114 and the sidewalls 168 of the tray 116. In some embodiments, only one of the first or second legs 172, 174 include an aperture 186 at the distal end thereof. The apertures are positioned adjacent to the top wall 184 to provide space between the aperture 186 and the bottom wall 132 of the base 114 to reduce or eliminate water flow into the venting channel 160.

In the illustrated embodiment of the venting clip 130, a tab 188 extends at an angle from each of the inner walls 176 of the first and second legs 172, 174 of the gap portion 164, as shown in FIGS. 8A-8E. The tabs 188 are oriented substantially perpendicular to the inner walls 176 and substantially parallel to the top wall 166 of the support portion 162. In some embodiments, the tabs 188 are spaced apart from the top wall 166. The tabs 188 are configured to be inserted into the corresponding slots 146 formed into the sidewalls 142 of the tray 116 in order to secure the venting clip 130 to the tray 116, as shown in FIG. 3B. In some embodiments, the venting clip 130 includes only one tab 188 for connecting the venting clip 130 to the tray 116. In other embodiments, the venting clip 130 does not include any tabs 188 such that the venting clip 130 is positioned between the base 114 and the tray 116 in an abutting manner.

Figure 9:
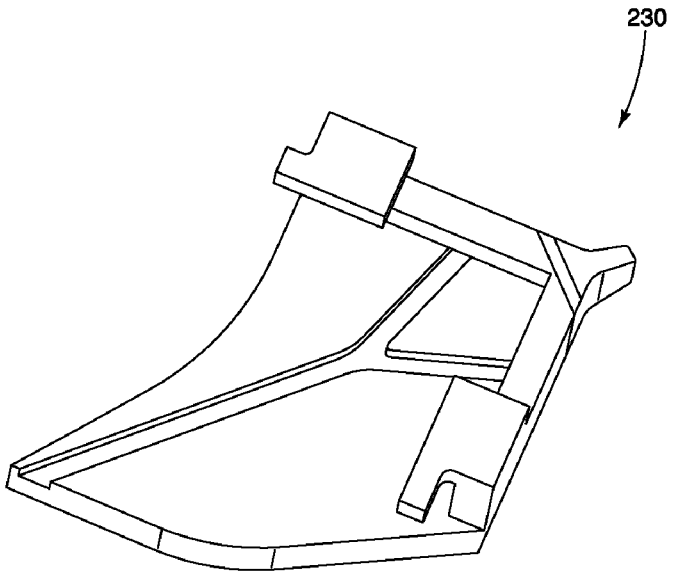
FIG. 9 is an alternative embodiment of a venting clip.

FIG. 9 illustrates an alternative embodiment of a venting clip 230. The venting clip 230 includes a support member that extends from the gap portion. The support member includes venting channel formed into the upper surface thereof. The venting channel extends to the partially hollow gap portion, wherein the gap portion includes an aperture to fluidly connect the venting channel to the ambient air surrounding the drain assembly.

Figure 10A:
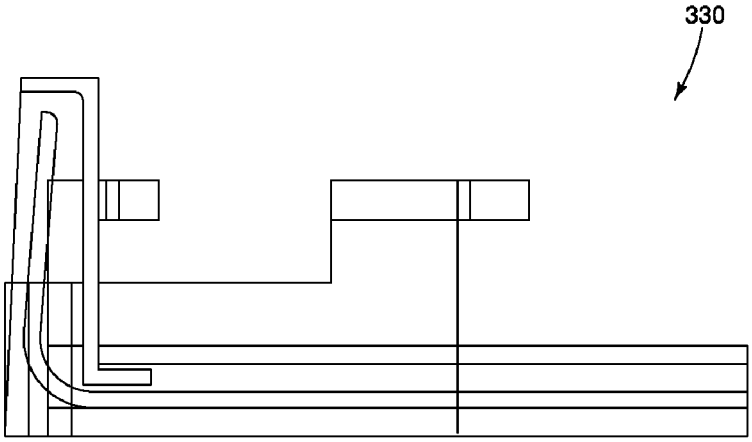
FIGS. 10A-10B show another alternative embodiment of a venting clip.
Figure 10B:
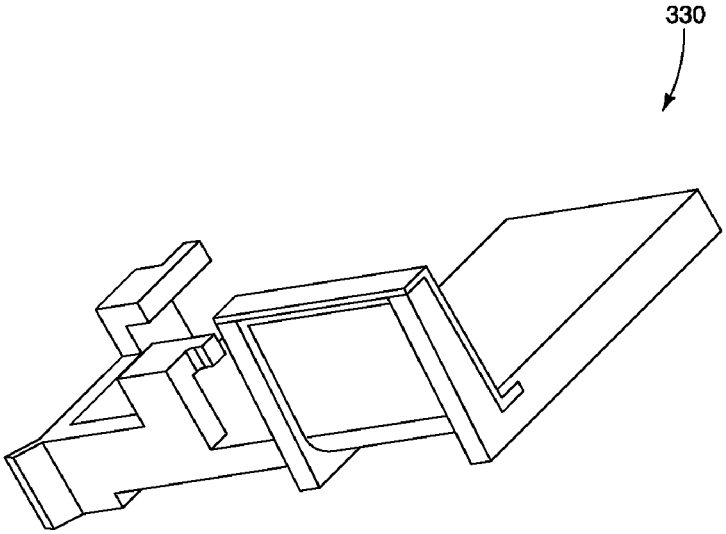

FIGS. 10A-10B illustrate another alternative embodiment of a venting clip 330. The venting clip 330 includes a gap portion located at the corner, and a support portion extending from the gap portion. A portion of the support portion is generally hollow, thereby forming a portion of the venting channel. A projection extending from the support portion and spaced apart from the gap portion provides a portion of the venting channel positioned between the base and the tray. The projection defines a portion of the venting channel for providing fluid communication between the ambient environment and the volume above the recessed portion of the bottom wall of the base and the central opening thereof.

Figure 11A:
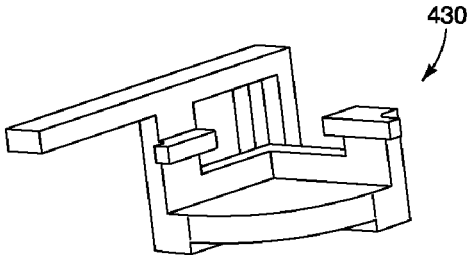
FIGS. 11A-11C show a further alternative embodiment of a venting clip.
Figure 11B:
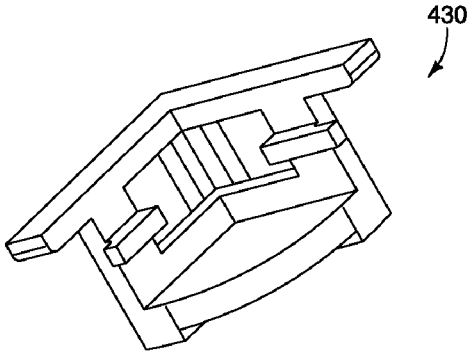
Figure 11C:
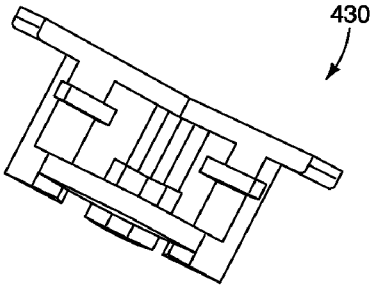

FIGS. 11A-11C illustrate yet another embodiment of a venting clip 430.

Figure 12A:
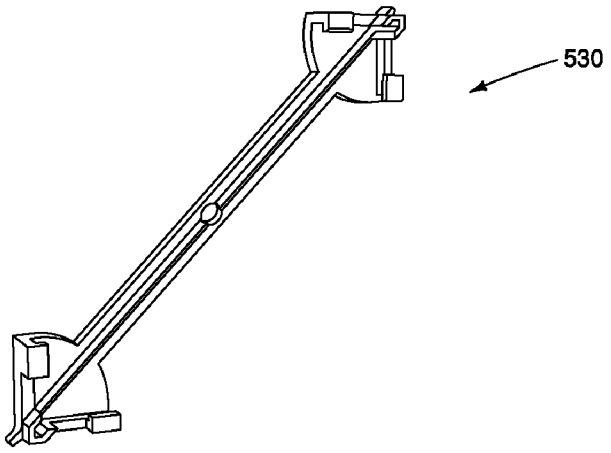
FIG. 12A shows yet another alternative embodiment of a venting clip.

FIG. 12A illustrates another alternative embodiment of a venting clip 530 that is configured to support opposing corners of the tray 116. The venting clip 530 extends across the entire diameter of the central opening of the base 114. The venting clip 530 includes a venting channel that extends between the opposing ends of the venting clip and fluidly connects the drain pipe and the ambient air above the drain assembly.

Figure 12B:
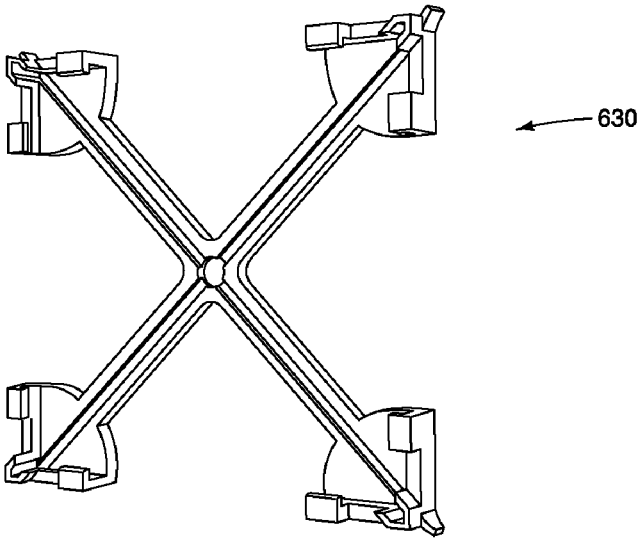
FIG. 12B shows an alternative embodiment of the venting clip shown in FIG. 12A.

FIG. 12B is yet another alternative embodiment of a venting clip 630 that is configured to support all four corners of the tray 116. The venting clip 630 extends across the entire diameter of the central opening of the base 114. The venting clip 630 includes a venting channel that extends between both pairs of opposing ends of the venting clip and fluidly connects the drain pipe and the ambient air above the drain assembly.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A drain assembly comprising:

a base defining a base volume, said base having sidewalls and a bottom wall extending between the sidewalls, wherein said bottom wall includes a recessed portion defining a central opening and a tube extending from said recessed portion for allowing water to drain from said base volume;

a tray positionable within said base volume; and two or more venting clips positioned between said tray and said base, each venting clip comprising a first venting clip sidewall having a first end that is proximal to a sidewall of the base and a second end that is proximal to the central opening of the base and that extends at least to the recessed portion of the base;

a second venting clip sidewall opposite and spaced apart from the first venting clip sidewall and having a first end that is proximal to a sidewall of the base and a second end that is proximal to the central opening of the base and that extends at least to the recessed portion of the base; and, a first end wall extending between the first end of the first venting clip sidewall and the first end of the second venting clip sidewall;

wherein the first venting clip sidewall, the second venting clip sidewall, and the first end wall contiguously define a venting channel for equalizing pressure between air within said tube and ambient air.

2. The drain assembly of claim 1, wherein the sidewalls of the base and the bottom wall of the base define said base volume therebetween, and wherein said tray includes a lower wall and sidewalls extending from said lower wall to define a tray volume therebetween.

3. The drain assembly of claim 2, wherein each venting clip includes a gap portion and a support portion, wherein said gap portion is positioned between said sidewalls of said base and said sidewalls of said tray and said support portion is positioned between said bottom wall of said base and said lower wall of said tray.

4. The drain assembly of claim 3, wherein said gap portion defines a portion of said venting channel and said support portion defines another portion of said venting channel, wherein said portions of said venting channel defined by said gap portion and said support portion are in fluid communication.

5. The drain assembly of claim 4, wherein an aperture is defined in said gap portion to fluidly connect said venting channel with said ambient air.

6. The drain assembly of claim 1, wherein a portion of each of said venting clips is positioned above said central opening for providing a fluid pathway between said air within said tube and said ambient air.

7. The drain assembly of claim 1, wherein said two or more venting clips includes only two venting clips positioned between said tray and said base.

8. The drain assembly of claim 1, wherein said two or more venting clips includes four venting clips, each venting clip being positioned at each corner of said tray.

9. The drain assembly according to claim 1, further comprising a second end wall extending between the second end of the first venting clip sidewall and the second end of the second venting clip sidewall and being positioned at least partially over the recessed portion of the base, wherein the first venting clip sidewall, the second venting clip sidewall, the first end wall, and the second end wall contiguously define the venting channel.

10. The drain assembly according to claim 1, wherein the second end of the first venting clip sidewall and the second end of the second venting clip sidewall extend at least partially over the recessed portion of the base.

11. A venting clip of a drain assembly for equalizing pressure between air within a drain pipe and ambient air, said venting clip comprising:

a support portion comprising a first venting clip sidewall having a first end and a second end; and, a second venting clip sidewall opposite and spaced apart from the first venting clip sidewall and having a first end and a second end; and a gap portion extending from said support portion and comprising a gap portion end wall contiguously extending between the first end of the first venting clip sidewall and the first end of the second venting clip sidewall, wherein the first venting clip sidewall, the second venting clip sidewall, and the gap portion end wall contiguously define a venting channel; and at least one aperture formed in said gap portion to fluidly connect air within said venting channel with ambient air to allow pressure normalization between air within said drain pipe and ambient air.

12. The venting clip of claim 11, wherein said support portion further includes a top wall joining the first venting clip sidewall, the second venting clip sidewall, and the gap portion end wall.

13. The venting clip of claim 12, wherein said gap portion includes a top wall and an inner wall and an outer wall extending from said top wall, said inner wall spaced apart from said outer wall.

14. The venting clip of claim 13, wherein an end wall is located at each distal end of said inner and outer walls, wherein each end wall connects said inner and outer walls and spaced apart from said top wall to define one of said at least one aperture therebetween.

15. The venting clip of claim 12, wherein said top wall, said first venting clip sidewall, and said second venting clip sidewall provide an inverted U-shape.

16. The venting clip of claim 11, further comprising a support portion end wall extending contiguously between the second end of the first venting clip sidewall and the second end of the second venting clip sidewall, wherein the first venting clip sidewall, the second venting clip sidewall, the gap portion end wall, and the support portion end wall contiguously define the venting channel.

17. A drain assembly comprising:

a base having a bottom wall and sidewalls extending upwards from the bottom wall, wherein said bottom wall includes a recessed portion defining a central opening for allowing water to drain from said base; and a venting clip positioned over said base, the venting clip comprising a first venting clip sidewall having a first end that is proximal to a sidewall of the base and a second end that is proximal to the central opening of the base and that is positioned at least partially over the recessed portion of the base;

a second venting clip sidewall opposite and spaced apart from the first venting clip sidewall and having a first end that is proximal to a sidewall of the base and a second end that is proximal to the central opening of the base and that is positioned at least partially over the recessed portion of the base;

a first end wall extending between the first end of the first venting clip sidewall and the first end of the second venting clip sidewall; and, an inner surface that is defined by an inward facing surface of the first venting clip sidewall, an inward facing surface of the second venting clip sidewall, and an inward facing surface of the first end wall, wherein the inner surface of the venting clip extends continuously from the second end of the first venting clip sidewall to the second end of the second venting clip sidewall, and wherein the inner surface of the venting clip at least partially defines a venting channel for equalizing pressure between ambient air and air within a tube extending from the central opening of the base.

18. The drain assembly according to claim 17, further comprising a second end wall extending between the second end of the first venting clip sidewall and the second end of the second venting clip sidewall, wherein the inner surface of the venting clip is further defined by an inward facing surface of the second end wall, and wherein the inner surface of the venting clip extends continuously in a closed loop path around the venting channel.

19. The drain assembly according to claim 18, wherein the second end of the first venting clip sidewall, the second end of the second venting clip sidewall, and the second end wall are positioned at least partially over the central opening of the base.

20. The drain assembly according to claim 17, wherein the venting clip further comprises a top wall extending between the first venting clip sidewall, the second venting clip sidewall, and the first end wall, and further defining the venting channel.

* * * * *